US009130311B2

(12) United States Patent
Gieski et al.

(10) Patent No.: US 9,130,311 B2
(45) Date of Patent: Sep. 8, 2015

(54) ELECTRICAL CONNECTOR

(71) Applicant: FCI Americas Technology LLC, Carson City, NV (US)

(72) Inventors: Christopher S. Gieski, Dillsburg, PA (US); Hung V. Ngo, Harrisburg, PA (US)

(73) Assignee: FCI Americas Technology, LLC, Carson City, NV (US)

( * ) Notice: Subject to any disclaimer, the term of this patent is extended or adjusted under 35 U.S.C. 154(b) by 39 days.

(21) Appl. No.: 13/752,574

(22) Filed: Jan. 29, 2013

(65) Prior Publication Data

US 2013/0196526 A1 Aug. 1, 2013

Related U.S. Application Data

(60) Provisional application No. 61/593,571, filed on Feb. 1, 2012.

(51) Int. Cl.

| | |
|---|---|
| ***H01R 13/64*** | (2006.01) |
| ***H01R 13/46*** | (2006.01) |
| ***H01R 43/24*** | (2006.01) |
| ***H01R 13/436*** | (2006.01) |
| ***H01R 13/631*** | (2006.01) |
| *H01R 13/506* | (2006.01) |
| *H01R 24/20* | (2011.01) |

(52) U.S. Cl.

CPC ..... *H01R 13/64* (2013.01); *H01R 13/436* (2013.01); *H01R 13/46* (2013.01); *H01R 13/6315* (2013.01); *H01R 43/24* (2013.01); *H01R 13/506* (2013.01); *H01R 24/20* (2013.01); *Y10T 29/4922* (2015.01)

(58) Field of Classification Search

USPC ..... 439/247, 95, 607.11, 498, 350–358, 439/567, 557, 552, 499

See application file for complete search history.

(56) References Cited

U.S. PATENT DOCUMENTS

| | | | | |
|---|---|---|---|---|
| 5,632,634 | A * | 5/1997 | Soes | 439/101 |
| 5,813,880 | A * | 9/1998 | Kodama | 439/364 |
| 5,902,155 | A * | 5/1999 | Polgar et al. | 439/680 |
| 6,273,750 | B1 * | 8/2001 | Malkowski, Jr. | 439/499 |
| 7,004,767 | B2 * | 2/2006 | Kim | 439/95 |
| 7,004,793 | B2 * | 2/2006 | Scherer et al. | 439/607.11 |
| 7,484,989 | B2 * | 2/2009 | Venaleck | 439/352 |
| 7,744,403 | B2 * | 6/2010 | Barr et al. | 439/499 |
| 8,202,105 | B2 | 6/2012 | Lord et al. | 439/247 |
| 8,475,177 | B2 * | 7/2013 | Crofoot et al. | 439/61 |
| 2009/0025974 | A1 | 1/2009 | Chen et al. | 174/377 |
| 2010/0130058 | A1 | 5/2010 | Hanyu | 439/565 |

FOREIGN PATENT DOCUMENTS

| | | | |
|---|---|---|---|
| KR | 20080068549 | A | 7/2008 |
| WO | WO-9207395 | A1 | 4/1992 |

* cited by examiner

*Primary Examiner* — Jean F Duverne

(74) *Attorney, Agent, or Firm* — Harrington & Smith

(57) ABSTRACT

An electrical connector including electrical terminals, and a housing. The housing includes a first housing member and a second housing member. The second housing member includes terminal receiving areas which house the electrical terminals. The second housing member includes projections into the terminal receiving areas to limit forward movement of the electrical terminals in the terminal receiving areas. The first housing member includes a plurality of projections respectively extending into each of the terminal receiving areas to limit rearward movement of the electrical terminals in the terminal receiving areas. The electrical terminals float in the terminal receiving areas between the projections of the first housing member and the projections of the second housing member.

20 Claims, 10 Drawing Sheets

ELECTRICAL CONNECTOR

CROSS REFERENCE TO RELATED APPLICATION

This application claims priority under 35 USC 119(e) on U.S. provisional patent application No. 61/593,571 filed Feb. 1, 2012 which is hereby incorporated by reference in its entirety.

BACKGROUND

1. Technical Field

The exemplary and non-limiting embodiments relate generally to an electrical connector and, more particularly, to a connector having a floating electrical terminal.

2. Brief Description of Prior Developments

Electrical connectors having a housing with terminal receiving areas are know where movement of terminals in the terminal receiving areas may foe limited. In most electrical connectors movement of the terminals in the housing is not desirable and, thus, are designed to avoid movement of the terminals. Some types of electrical contacts have terminals which can move, but mounting the terminals to the housing may involve expensive assembly or part design/manufacturing processes.

SUMMARY

The following summary is merely intended to be exemplary. The summary is not intended to limit the scope of the claims.

In accordance with one aspect, an example electrical connector housing comprises a first housing member comprising at least two projections; and a second housing member comprising at least two terminal receiving areas. The second housing member comprises a projection in each of the terminal receiving areas adapted to limit forward movement of terminals in the terminal receiving areas and at least one bottom section configured to limit movement of terminals in a bottom direction. The at least one bottom section comprises apertures, where the at least two projections are configured to extend through the apertures into the at least two terminal receiving areas to limit rearward movement of the terminals in the terminal receiving areas. The electrical connector housing is configured to allow the terminals to float between the projections of the first housing member and the projections of the second housing member.

In accordance with another aspect, an example method comprises providing a first housing member comprising a projection; inserting an electrical terminal into a second housing member, where a ledge of the electrical terminal contacts a projection in a terminal receiving area of the second housing member to limit forward movement of the electrical terminal in the terminal receiving area; and connecting the first housing member to the second housing member where the projection of the first housing member extends through an aperture in the second housing member into the terminal receiving area behind a stop of the terminal to limit rearward movement of the terminal in the terminal receiving area, where the terminal floats between the projection of the first housing member and the projection of the second housing member.

In accordance with another aspect, an example electrical connector includes electrical terminals, and a horsing. The housing includes a first housing member and a second housing member. The second housing member includes terminal receiving areas which house the electrical terminals. The second housing member includes projections into the terminal receiving areas to limit forward movement of the electrical terminals in the terminal receiving areas. The first housing member includes a plurality of projections respectively extending into each of the terminal receiving areas to limit rearward movement of the electrical terminals in the terminal receiving areas. The electrical terminals float in the terminal receiving areas between the projections of the first housing member and the projections of the second housing member.

BRIEF DESCRIPTION OF THE DRAWINGS

The foregoing aspects and other features are explained in the following description, taken in connection with the accompanying drawings, wherein.

DETAILED DESCRIPTION OF EMBODIMENTS

Figure 1:
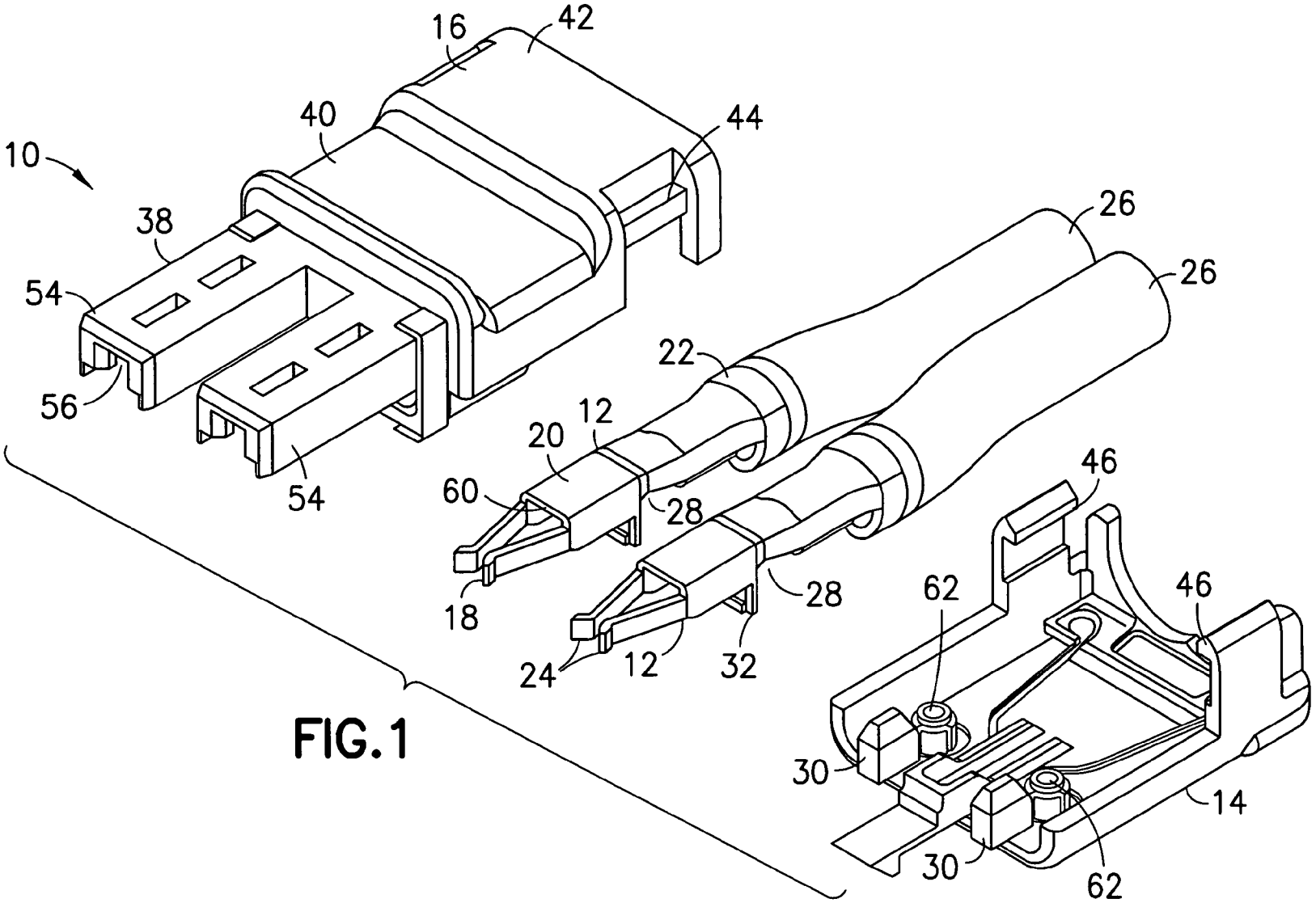
FIG. 1 is an exploded perspective view of an example embodiment.

Referring to FIG. 1, there is shown an exploded perspective view of an electrical connector 10 incorporating features of an example embodiment. Although the features will be described with reference to the example embodiments shown in the drawings, it should be understood chat features can be embodied in many alternate forms of embodiments. In addition, any suitable size, shape or type of elements or materials could be used.

The connector 10 generally comprises two electrical contacts 12 and a housing comprises housing members 14, 16. The contacts 12 each have a front end 18, a middle section 20 and a rear end 22. The front end 18 has deflectable cantilevered beams 24. The beams 24 are adapted to removably receive a male contact of a mating electrical connector (not shown). The middle sections 20 are used to mount the contact 12 in the housing between the housing members 14, 16. The middle sections 20 each include an area 28 adapted to receive a projection 30 of the first housing member 14. The middle section 20 has a stop 32 located at the front of the area 28. The stop 32 has a general downward loop shape formed by cantilevered arms 34, 36 (see FIG. 2) of the middle section. One of the arms 34 has a general straight cantilevered shape. The other one of the arms is also cantilevered, but has a general L shape. The rear ends 22 are crimped on the electrical conductors of the wires/cables 26.

Figure 2:
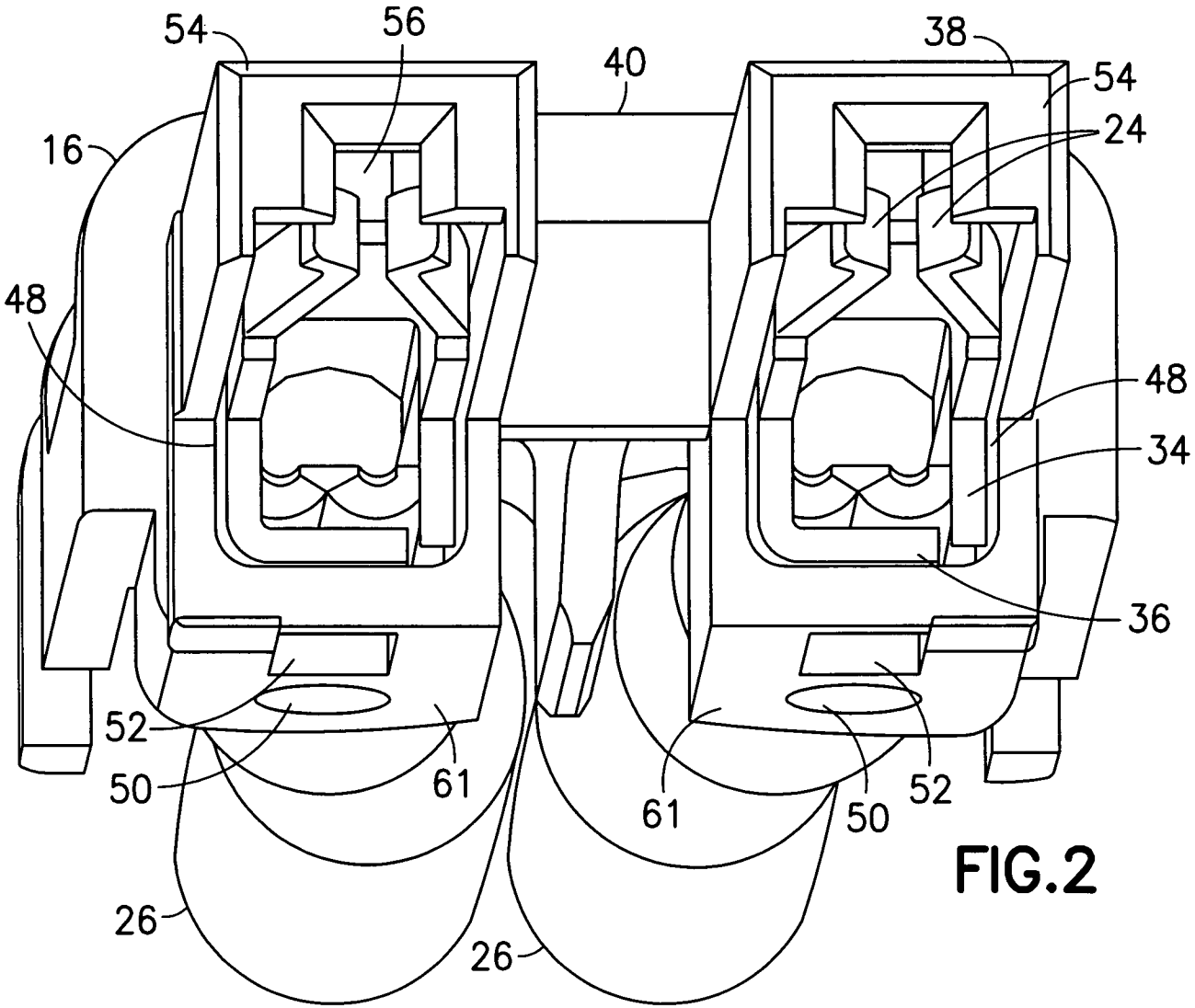
FIG. 2 is a bottom, front perspective view of the top housing member and the terminals of the connector shown in FIG. 1.
Figure 3:
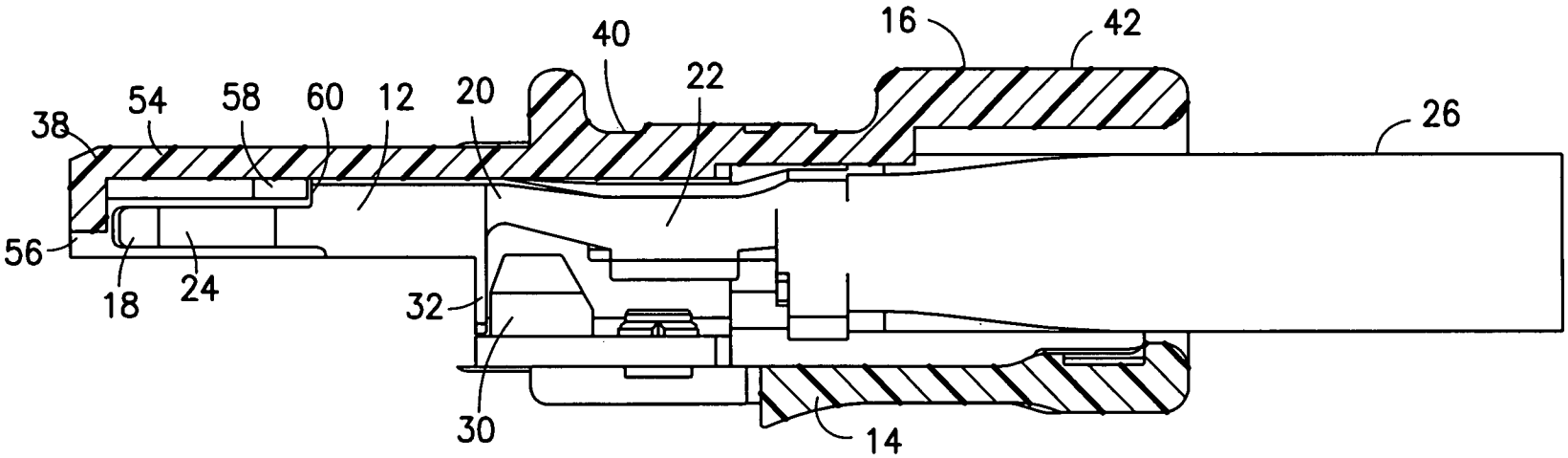
FIG. 3 is a schematic cross sectional view of the connector shown in FIG. 1.
Figure 4:
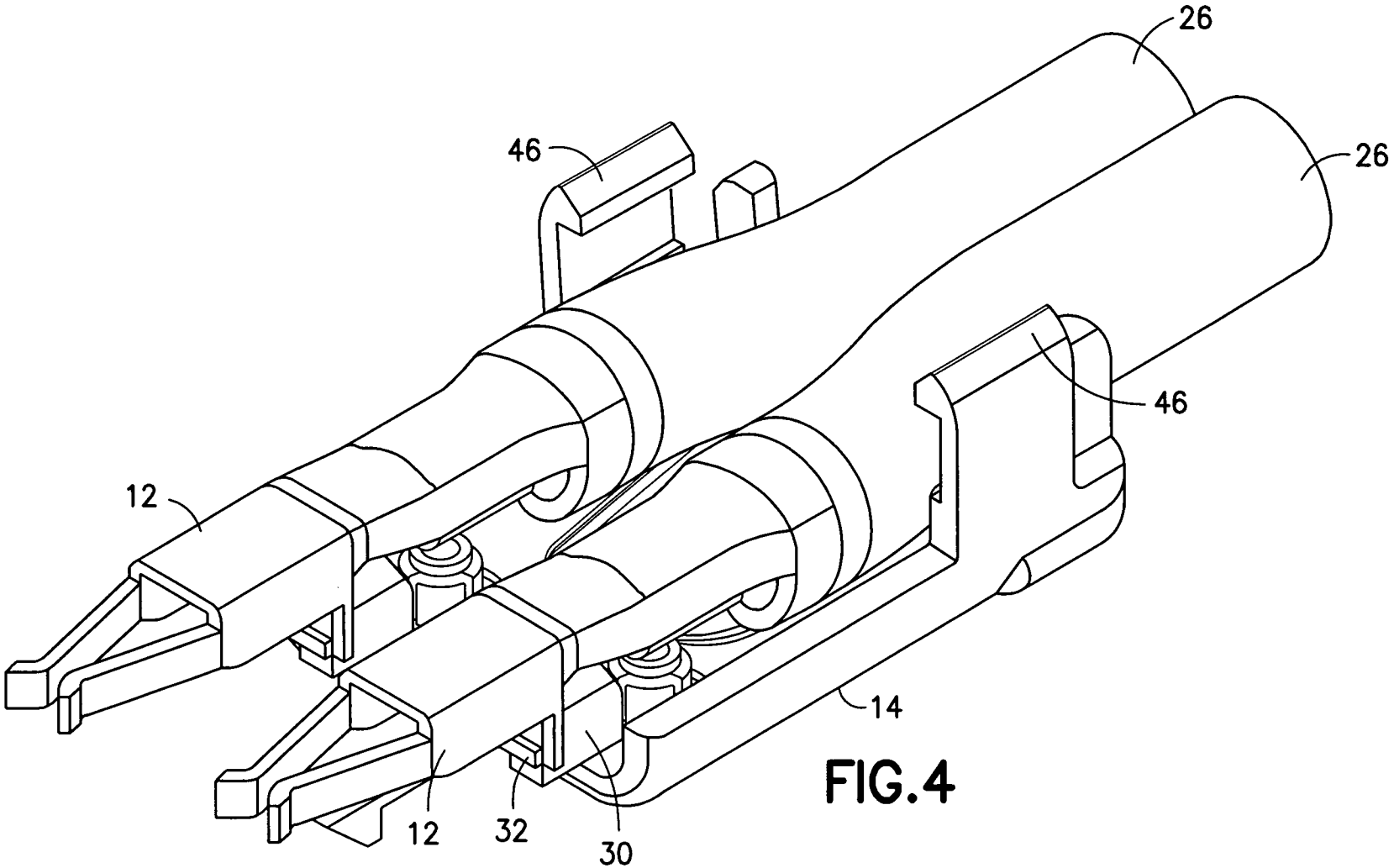
FIG. 4 is a perspective view of the bottom housing member and the terminals of the connector shown in FIG. 1.
Figure 5:
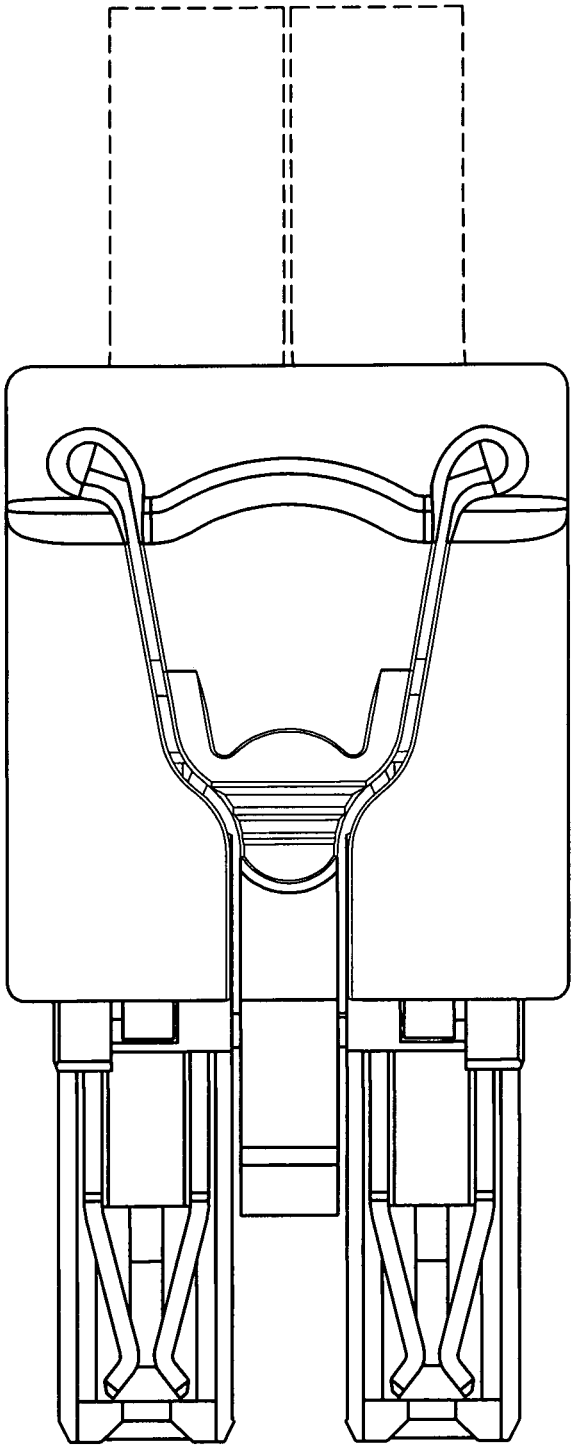
FIG. 5 is a bottom plan view of the connector shown in FIG. 1.
Figure 6:
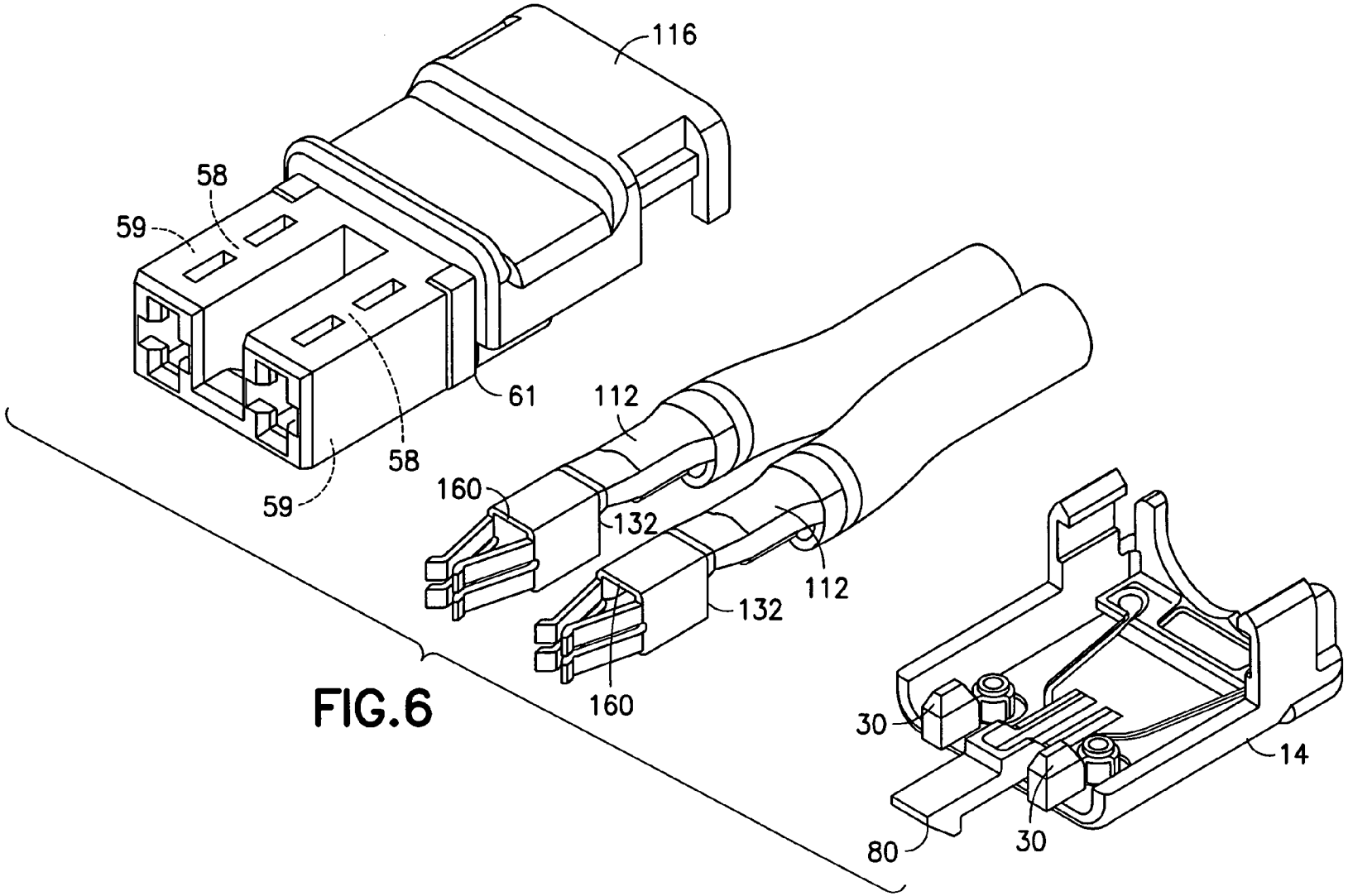
FIG. 6 is an exploded perspective view of another example embodiment.
Figure 7:
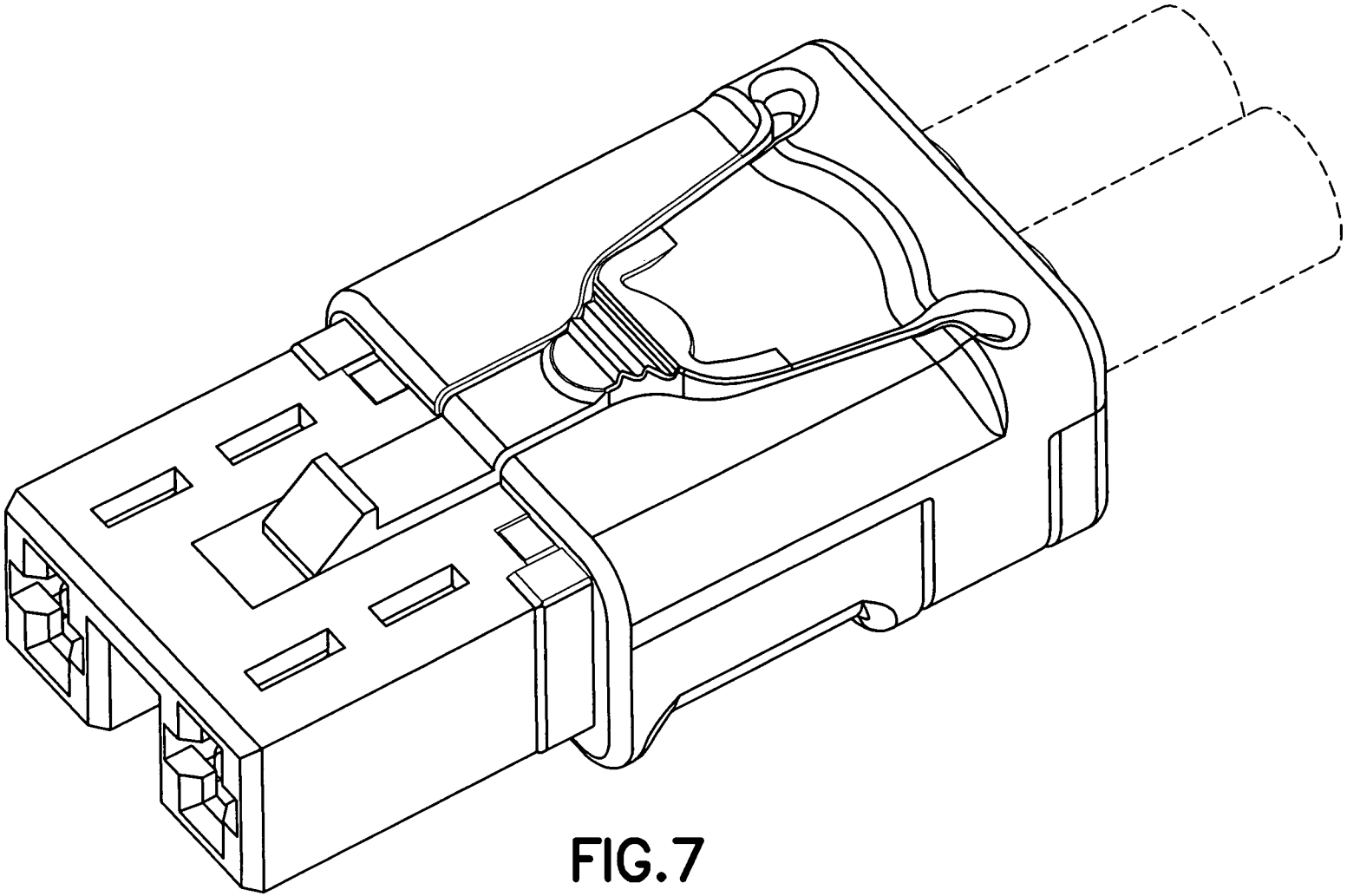
FIG. 7 is a bottom perspective view of the connector shown in FIG. 6.
Figure 8:
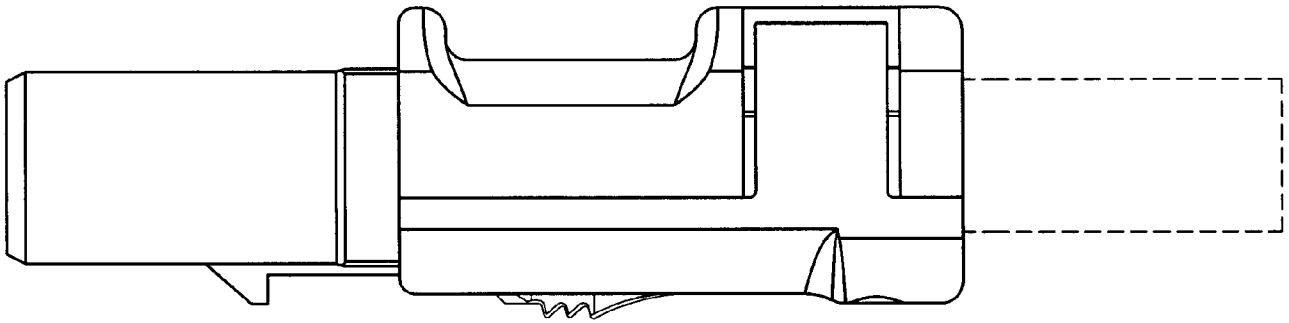
FIG. 8 is a side view of the connector shown in FIG. 6.
Figure 9:
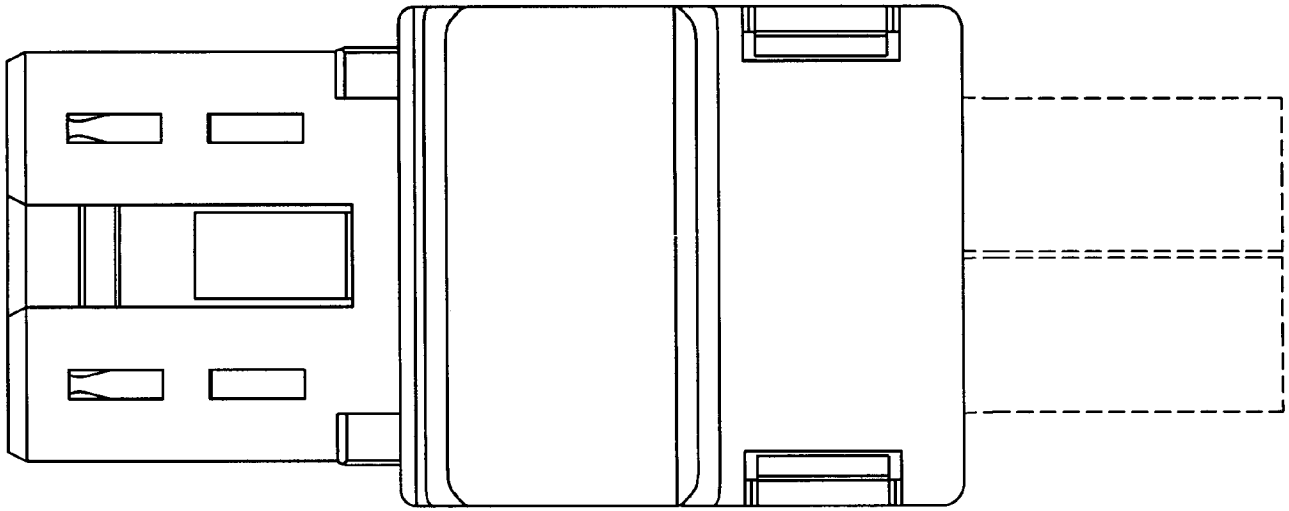
FIG. 9 is a top view of the connector shown in FIG. 6.
Figure 10:
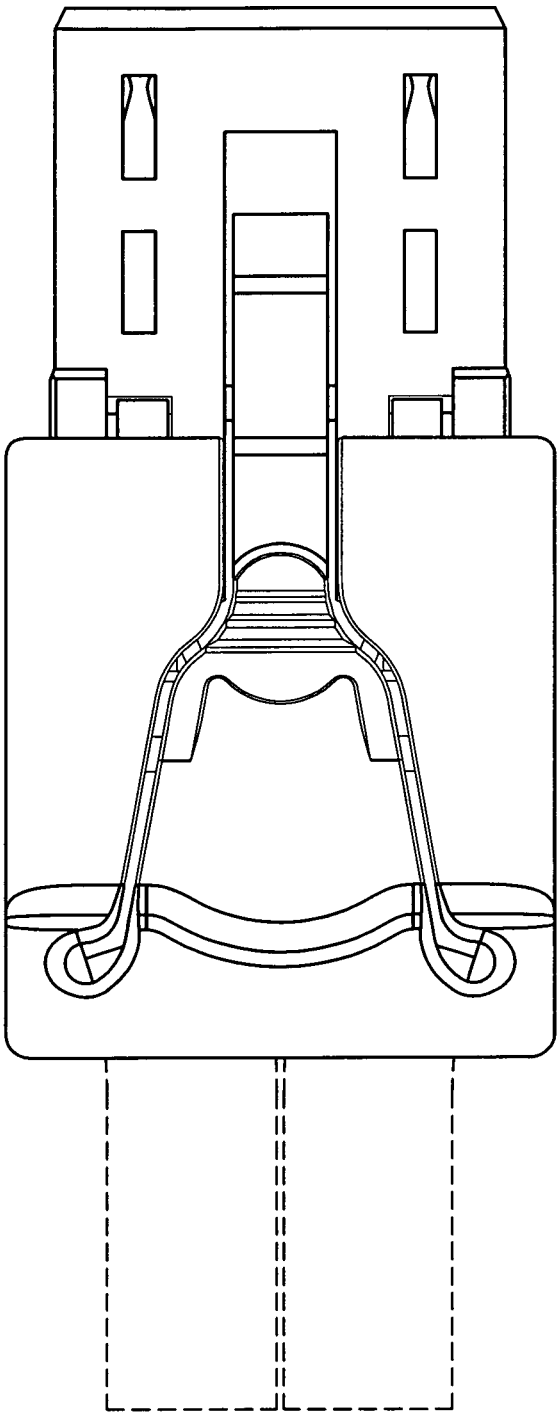
FIG. 10 is a bottom plan view of the connector shown in FIG. 6.
Figure 11:
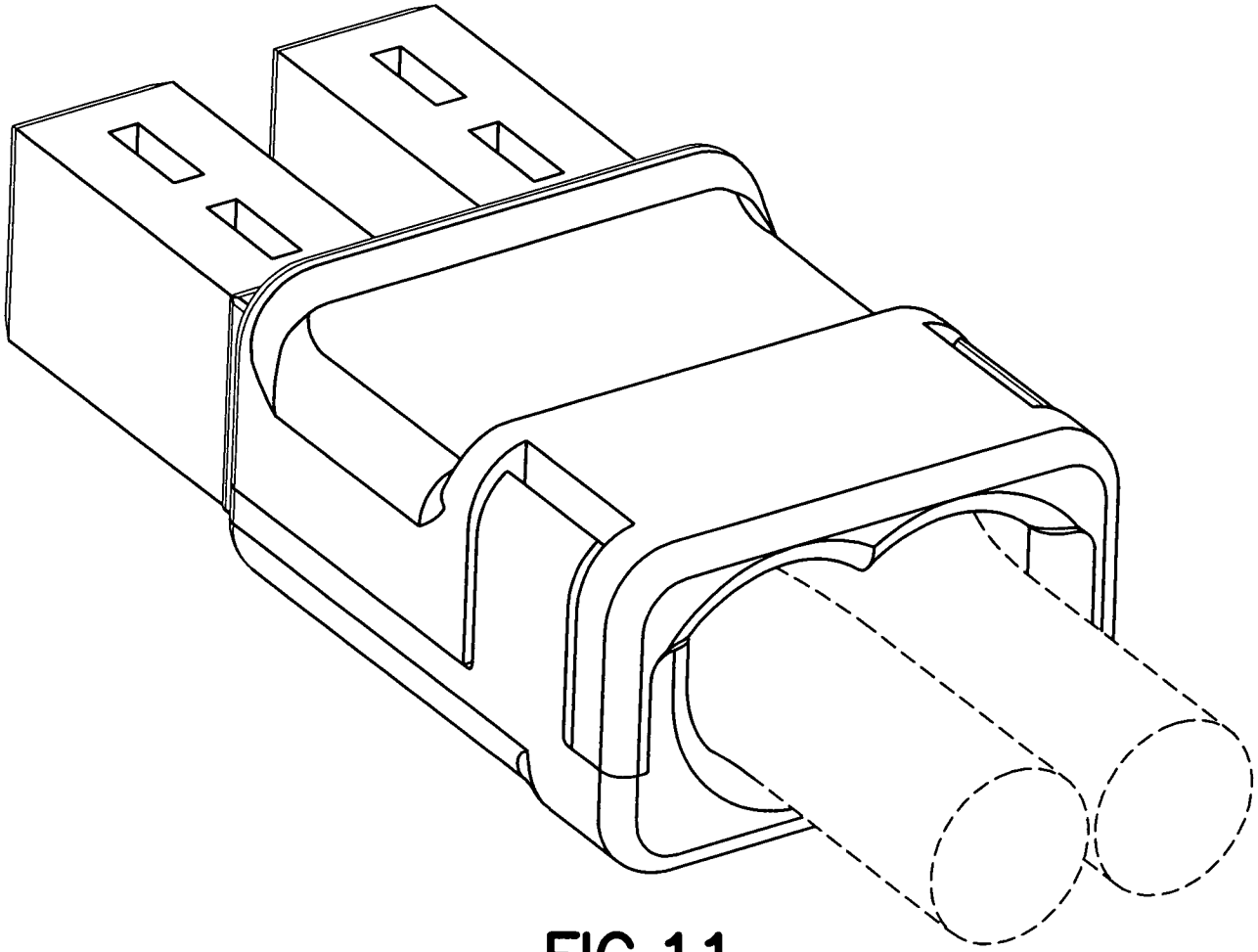
FIG. 11 is a top, rear and side perspective view of the connector shown in FIG. 6.

Referring also to FIGS. 2 and 3, FIG. 2 shows the connector without the first housing member 14 attached. The second housing member 16 has a front section 38, a middle section 40 and a rear section 42. The front section 38 comprises two forward projecting cantilevered sections 54 with an aperture in the front for a male contact to be inserted into the connector. The front sections are also open along their bottom sides after the first housing member 14 is connected to the second housing member 16. The rear section 42 has an area for receiving the wires 26, and side ledges 44 to latch with latches 46 of the first housing member 14. The middle section 40 forms an area for receiving the rear and middle sections 22, 20 of the contacts 12. As seen best in FIG. 2, the middle section 40 forms two contact receiving channels 48.

The contact receiving channels 48 are enclosed except at their fronts and front bottom side, rears, and with holes 50, 52 at their bottom sides. The front section 38 has the two cantilevered projections 54. The projections form front contact receiving channels to house the front ends 18 of the contacts 12. The bottom of each projection 54 is open. The front end of each projection has a male contact insertion aperture 56. A projection 58 (see FIG. 3) extends down from the top wall of the projection 54 into the forward contact receiving channel.

Assembly of the connector comprises the contacts 12 being inserted in the second housing member 16, and then the first housing member 14 is connected to the second housing member 16 by the latches 46. As seen best in FIG. 3, the projection 58 are located in front of a ledge 60 of the contact 12, and the projection 30 is located behind the stop 32. Thus, the contact 12 is trapped between the stop 32 and the projection 58. The arrangement, however, allows the contact 12 to float inside the housing.

The projections 30 are able to pass through the holes 52 to be located behind the stops 32. The bosses 62 are able to be located in the holes 50, and perhaps ultrasonically welded in the holes 50 for example.

FIGS. 6-11 show an alternate example embodiment. The first housing member 14 is the same as in the first embodiment. The terminals 112 are slightly different from the terminals 12. However, the terminals 112 comprise a stop 132 and a ledge 160. The second housing member 116 has a front section with does not have an open bottom side. Instead the bottom side of the front section is closed. The front section has portions of two terminal receiving areas each having a projection 58 the same as in the first embodiment. When the terminals 112 are inserted into the terminal receiving areas 59 of the second housing member 116, the ledges 160 are stopped by contact with the projections 58.

After the terminals are inserted, the first housing member 14 is connected to the second housing member 116. The projections 30 extend through holes or apertures in the bottom side of the second housing 116. The projections 30, thus, extend into the terminal receiving areas of the second housing member 116. The top ends of the projections 30 extend behind the stops 132. Thus, a portion of the terminals in trapped between the two projections 58, 30 in each terminal receiving area. The arrangement, however, allows the contact 12 to float inside the housing.

An example electrical connector housing may comprise a first housing member 14 comprising at least two projections 30; and a second housing member 16, 116 comprising at least two terminal receiving areas, where the second housing member comprises a projection in each of the terminal receiving areas adapted to limit forward movement of terminals 12, 112 in the terminal receiving areas and at least one bottom section 61 configured to limit movement of terminals in a bottom direction, where the at least one bottom section comprises apertures 50, where the at least two projections 30 are configured to extend through the apertures 50 into the at least two terminal receiving areas 59 to limit rearward movement of the terminals 12, 112 in the terminal receiving areas, where the electrical connector housing is configured to allow the terminals to float between the projections 30 of the first housing member 14 and the projections 58 of the second housing member 16, 116.

The projections 58 of the second housing member may be cantilevered projections which project downward into the terminal receiving areas from a top section of the second housing member. The second housing member may comprise cantilevered forward projection sections 54 which form front sections of the terminal receiving areas. Bottom sides of the cantilevered forward projection sections may be substantially open (see FIGS. 2 and 3) after the first housing member is connected to the second housing member. The first housing member may comprise a cantilevered deflectable latch 80 which is configured to latch with a mating electrical connector.

An example electrical connector may comprise electrical terminals; and the electrical connector housing described above, where the electrical terminals are located in the terminal receiving areas of the housing, where the electrical terminals each comprise a downward extending stop 32, where the projections 30 of the first housing member are located behind the stops 32. The stops 32 of the electrical terminals may each comprise a substantially loop shape. The stops 32 of the electrical terminals may each comprise a first cantilevered leg 34 from a first side of the electrical terminal and a second cantilevered leg 36 from a second opposite side of the electrical terminal.

An example method may comprise providing a first housing member comprising a projection; inserting an electrical terminal into a second housing member, where a ledge of the electrical terminal contacts a projection in a terminal receiving area of the second housing member to limit forward movement of the electrical terminal in the terminal receiving area; and connecting the first housing member to the second housing member where the projection of the first housing member extends through an aperture in the second housing member into the terminal receiving area behind a stop of the terminal to limit rearward movement of the terminal in the terminal receiving area, where the terminal floats between the projection of the first housing member and the projection of the second housing member.

The projection of the second housing member is provided as a cantilevered projection which projects downward into the terminal receiving area from a top section of the second housing member. The second housing member is provided with cantilevered forward projection sections which form front sections of two of the terminal receiving areas. Bottom sides of the cantilevered forward projection sections are maintained substantially open after the first housing member is connected to the second housing member. The electrical terminal may be provided with a downward extension which forms the stop, where the projection of the first housing member is located behind the stop. The stop of the electrical terminal may be provided as a substantial loop shape. The stop of the electrical terminal may be formed by a first cantilevered leg from a first side of the electrical terminal and a second cantilevered leg from a second opposite side of the electrical terminal.

An example electrical connector may comprise electrical terminals; and a housing, where the housing comprises a first housing member and a second housing member, where the second housing member comprises terminal receiving areas which house the electrical terminals, where the second housing member comprises projections into the terminal receiving areas to limit forward movement of the electrical terminals in the terminal receiving areas, where the first housing member comprises a plurality of projections respectively extending into each of the terminal receiving areas to limit rearward movement of the electrical terminals in the terminal receiving areas, and where the electrical terminals float in the terminal receiving areas between the projections of the first housing member and the projections of the second housing member.

The electrical terminals may each comprise a downward extending stop, where the projections of the first housing member are located behind the stops. The stops of the electrical terminals may each comprise a substantial loop shape. The stops of the electrical terminals may each comprise a first cantilevered leg from a first side of the electrical terminal and a second cantilevered leg from a second opposite side of the electrical terminal. A first one of the legs may have an L shape.

It should be understood that the foregoing description is only illustrative. Various alternatives and modifications can be devised by those skilled in the art. For example, features recited in the various dependent claims could be combined with each other in any suitable combination(s). In addition, features from different embodiments described above could be selectively combined into a new embodiment. Accordingly, the description is intended to embrace all such alternatives, modifications and variances which fall within the scope of the appended claims.

What is claimed is:

1. An electrical connector comprising:

electrical terminals; and an electrical connector housing, where the electrical terminals are located in the terminal receiving areas of the housing, the electrical connector housing comprising:

a first housing member comprising at least two projections; and a second housing member comprising at least two terminal receiving areas, where the second housing member comprises a projection in each of the terminal receiving areas limiting forward movement of the electrical terminals in the terminal receiving areas and at least one bottom section limiting movement of the electrical terminals in a bottom direction, where the at least one bottom section comprises apertures, where the at least two projections of the first housing member extend through the apertures into the at least two terminal receiving areas of the second housing member to limit rearward movement of the electrical terminals in the terminal receiving areas, where the electrical connector housing allows the electrical terminals to float between the projections of the first housing member and the projections of the second housing member.

2. An electrical connector as in claim where the projections of the second housing member are cantilevered projections which project downward into the terminal receiving areas from a top section of the second housing member.

3. An electrical connector as in claim where the second housing member comprises cantilevered forward projection sections which form front sections of the terminal receiving areas.

4. An electrical connector as in claim 3 where bottom sides of the cantilevered forward projection sections are substantially open after the first housing member is connected to the second housing member.

5. An electrical connector as in claim 1 where the first housing member comprises a cantilevered deflectable latch which is configured to latch with a mating electrical connector.

6. An electrical connector as in claim 1, where the electrical terminals each comprise a downward extending stop, where the projections of the first housing member are located behind the stops.

7. An electrical connector as in claim 6 where the stops of the electrical terminals each comprise a substantially loop shape.

8. An electrical connector as in claim 6 where the stops of the electrical terminals each comprise a first cantilevered leg from a first side of the electrical terminal and a second cantilevered leg from a second opposite side of the electrical terminal.

9. A method comprising:

providing a first housing member comprising a projection;

inserting an electrical terminal into a second housing member, where a ledge of the electrical terminal contacts a projection in a terminal receiving area of the second housing member to limit forward movement of the electrical terminal in the terminal receiving area; and connecting the first housing member to the second housing member where the projection of the first housing member extends through an aperture in the second housing member into the terminal receiving area behind a stop of the terminal to limit rearward movement of the terminal in the terminal receiving area, where the terminal floats between the projection of the first housing member and the projection of the second housing member.

10. A method as in claim 9 where the projection of the second housing member is provided as a cantilevered projection which project downward into the terminal receiving area from a top section of the second housing member.

11. A method as in claim 9 where the second housing member is provided with cantilevered forward projection sections which form front sections of two of the terminal receiving areas.

12. A method as in claim 9 where bottom sides of the cantilevered forward projection sections are maintained substantially open after the first housing member is connected to the second housing member.

13. A method as in claim 9 where the electrical terminal is provided with a downward extension which forms the stop, where the projection of the first housing member is located behind the stop.

14. A method as in claim 13 where the stop of the electrical terminal is provided as a substantial loop shape.

15. A method as in claim 9 where the stop of the electrical terminal is formed by a first cantilevered leg from a first side of the electrical terminal and a second cantilevered leg from a second opposite side of the electrical terminal.

16. An electrical connector comprising:

electrical terminals; and a housing, where the housing comprises a first housing member and a second housing member, where the second housing member comprises terminal receiving areas which house the electrical terminals, where the second housing member comprises projections into the terminal receiving areas to limit forward movement of the electrical terminals in the terminal receiving areas, where the first housing member comprises a plurality of projections respectively extending into each of the terminal receiving areas to limit rearward movement of the electrical terminals in the terminal receiving areas, and where the electrical terminals float in the terminal receiving areas between the projections of the first housing member and the projections of the second housing member.

17. An electrical connector as in claim 16 where the electrical terminals each comprise a downward extending stop, where the projections of the first housing member are located behind the stops.

18. An electrical connector as in claim 17 where the stops of the electrical terminals each comprise a substantial loop shape.

19. An electrical connector as in claim 17 where the stops of the electrical terminals each comprise a first cantilevered leg from a first side of the electrical terminal and a second cantilevered leg from a second opposite side of the electrical terminal.

20. An electrical connector as in claim 17 where a first one of the legs has an L shape.

* * * * *

UNITED STATES PATENT AND TRADEMARK OFFICE

CERTIFICATE OF CORRECTION

PATENT NO. : 9,130,311 B2
APPLICATION NO. : 13/752574
DATED : September 8, 2015
INVENTOR(S) : Gieski et al.

It is certified that error appears in the above-identified patent and that said Letters Patent is hereby corrected as shown below:

In the claims

Claim 2, col. 5, line 52 --1-- should be inserted in between “claim” and “where”.

Claim 3, col. 5, line 56 --1-- should be inserted in between “claim” and “where”.

Signed and Sealed this
Fifteenth Day of December, 2015

Michelle K. Lee

Michelle K. Lee
*Director of the United States Patent and Trademark Office*